United States Patent [19]

Jeschke et al.

[11] Patent Number: 4,722,274

[45] Date of Patent: Feb. 2, 1988

[54] DEVICE FOR CONTROLLING BY A MEASURING TECHNIQUE, DAMPENING MEDIUM GUIDANCE ZONEWISE IN AN INKING UNIT FOR AN OFFSET PRINTING MACHINE

[75] Inventors: Willi Jeschke; Dimitrios Pyliotis, both of Heidelberg, Fed. Rep. of Germany

[73] Assignee: Heidelberger Druckmaschinen AG, Heidelberg, Fed. Rep. of Germany

[21] Appl. No.: 830,063

[22] Filed: Feb. 14, 1986

Related U.S. Application Data

[63] Continuation-in-part of Ser. No. 633,149, Jul. 23, 1984, abandoned.

[30] Foreign Application Priority Data

Jul. 23, 1983 [DE] Fed. Rep. of Germany ..... 3326698

[51] Int. Cl.[4] ..... B41F 7/26; B41F 31/26

[52] U.S. Cl. ..... 101/148; 101/349; 101/DIG. 24

[58] Field of Search ..... 101/148, 147, 350, 363, 101/365, 207, 208-210, DIG. 24

[56] References Cited

U.S. PATENT DOCUMENTS

| | | | |
|---|---|---|---|
| 3,439,175 | 4/1969 | Kammüller | 101/148 X |
| 3,756,725 | 9/1973 | Manring | 356/195 |
| 4,407,197 | 10/1983 | Jeschke | 101/349 |
| 4,565,450 | 1/1986 | Burkhardtwirz | 101/148 |

*Primary Examiner*—J. Reed Fisher

*Attorney, Agent, or Firm*—Herbert L. Lerner; Laurence A. Greenberg

[57] ABSTRACT

A device for controlling, by a measuring technique, the dampening medium guidance zonewise in an inking unit of an offset printing machine includes a measuring roller engaging an ink applicator roller of the inking unit and having interfaced oleophilic and hydrophilic surface regions, and an optoelectronic measuring device disposed adjacent to the measuring roller and operating thereon over the entire width thereof at a spaced distance therefrom, and wherein at least the oleophilic surface regions of the measuring roller is formed as a screen.

12 Claims, 6 Drawing Figures

DEVICE FOR CONTROLLING BY A MEASURING TECHNIQUE, DAMPENING MEDIUM GUIDANCE ZONEWISE IN AN INKING UNIT FOR AN OFFSET PRINTING MACHINE

This application is a Continuation-In-Part of application Ser. No. 633,149, filed July 23, 1984, now abandoned.

The invention relates to a device for controlling, by a measuring technique, dampening medium guidance zonewise in an inking unit of an offset printing machine and, more particularly, to such a device having a measuring roller and being provided partly with oleophilic and partly hydrophilic surface area regions, and an opto-electronic measuring device associated with the measuring roller and operating contact-free over the entire width of the latter.

In an offset printing process, the balance between dampening medium and ink on the offset printing plate is of decisive importance with respect to the quality of the printed product to be produced. The production of this optimal balance and the subsequent maintenance thereof demands a great amount of experience on the part of the printer with a considerable consumption of time for effecting the required adjustments or settings with respect to the dampening and/or the inking.

Zonal control and regulation, respectively, of the ink feed takes into account that the ink demand or requirement of a printed image, as viewed over the width of the printing form, is dependent upon the respective surface area coverage. On the other hand, the dampening medium is fed to the printing plate, over the entire width thereof, in the form of a film which is as thin and uniform as possible. In an equivalent manner, for the ink requirement, also more dampening medium may be necessary, however, at specific local regions of the printing plate than at the other locations of the printing plate. To cope with this locally increased ink requirement, an effort is made to remedy the situation by feeding an average quantity of dampening medium over all of the image regions, on the assumption that an ink-/dampening medium emulsion is formed in the inking unit which produces the required balance or equilibrium. Measurements of the dampening-medium content in the ink within the inking unit have indicated, however, that the composition of the ink/dampening-medium emulsion which forms in the printing unit differs to such an extent that quality-reducing printing problems occur therefrom even though the dampening-medium feed should be correct.

Many of the conventional measuring devices used for controlling dampening-medium feed generally present a disadvantage in that the measured values thereof do not take into account adequately whether an inking of the printing plate meeting the sought-after printing quality has been instituted or the inking process has, in fact, been interrupted. For this reason the conventional devices are suited only to a limited extent for control of a correct inking of a printing plate.

Even an apparently adequate thickness of a dampening medium layer or film on a hydrophilic surface element of the printing plate, which is provided so as not to accept ink, offers no guarantee that this surface element will also actually remain free of ink. In the contrary, there is a risk that, because of increased evaporation of the dampening medium on this printless surface element, ink will nevertheless be received thereon and, thereby, the quality-reducing fault known as greasing or scumming will thereby occur. If the dampening-medium guidance is to be optimized and to be maintained under control zonewise within a narrow tolerance range, all of the heretofore know measuring devices of this general type are not able to offer a satisfactory solution therefor.

Although the device disclosed in German Published Prosecuted Application (DE-AS) No. 27 36 663, in order to avoid various disadvantages of the prior state of the art, already affords the establishment of a definite relation between the ink film thickness and the dampening film thickness, respectively, even with this innovation, the partially differing or varying evaporation of the dampening medium on the printing plate due to local heating is not taken into account to a sufficient extent.

The invention makes good use of the realization that both chromium as well as aluminum rollers run blank as connecting rollers between the inking and dampening units i.e. preferably receive or take-up damping medium and, in dampened condition, repel ink.

Proceeding from this realization, it is accordingly an object of the instant application to provide an apparatus, that at relatively low manufacturing expense, by means of which variations in dampening-medium of the printing ink, resulting from partially varying evaporation of the dampening medium as well as from varying ink consumption, is able to determine exactly by measuring techniques, and subsequently use it for the dampening-medium feed in a zonewise manner uniformly over the entire width of the printing machine.

With the foregoing and other objects in view, there is provided, in accordance with the invention, a device for controlling, by a measuring technique, dampening medium guidance zonewise in an inking unit of an offset printing machine, which includes a measuring roller engaging an ink applicator roller of the inking unit and having partly oleophilic and partly hydrophilic surface regions, and an opto-electronic measuring device disposed adjacent to the measuring roller and operating thereon over the entire width thereof at a spaced distance therefrom, and wherein at lest the oleophilic surface regions of said measuring roller is formed as a screen. By selecting this specific surface configuration, dampening-medium feed can be controlled very effectively zonewise for the purpose of achieving trouble-free printing quality even within a narrow tolerance range, because the surface area coverage of the oleophilic screen with ink is greatly dependent upon the dampening-medium content thereof and thereby represents indirectly a measure of the dampening-medium guidance or control. Even the smallest variations in the surface area coverages permits one to draw a conclusion reliably with respect to variations in the ink/dampening-medium balance and thus with respect to the presence of too much or too little dampening medium, whereby especially the uniformity of the measured results of all of the ink zones over the entire width of the printing machine is of particular advantage. Due to empirical selection of various extents or degrees of area coverages of the oleophilic screen, the sensitivity of the measuring device can be improved and, thereby, precise data regarding the dampening-medium feed are obtainable.

In order to avoid undesired markings on the print, and in accordance with another feature of the invention, the oleophilic screen has a uniform surface area coverage of a selected degree in both longitudinal and circumferential directions of the measuring roller.

In accordance with a further feature of the invention, the oleophilic screen, in longitudinal direction of the measuring roller has a uniform surface area coverage to a selected degree and, in circumferential direction of the measuring drum, has a non-uniform stepped surface area coverage, with at least two different degrees of area coverage.

In accordance with an additional feature of the invention, the oleophilic screen extends steplessly or continuously in circumferential direction of the measuring roller with a degree of area coverage decreasing from 100% to 0%. This provides the measuring roller with a higher measurement sensitivity and consequently results in an improved differentiation of the area coverage which is reflected in a likewise stepless and precise indication or display of the measurement results.

In other words, in accordance with an additional feature of the invention, the relative area coverage A (v), measured as a function of the circumferential angle v, extends steplessly (i.e. continuously) in circumferential direction of the measuring roller from a first point on the circumference whereat v=0 degrees to an endpoint whereat v=360 degrees from a value of A (v)=0% to A (v)=100.

In accordance with an added feature of the invention, the surface regions of the oleophilic screen are formed of copper, and the remaining hydrophilic surface regions are formed of a metal selected from the group consisting of aluminum and chromium.

In accordance with yet another feature of the invention, the opto-electronic measuring device comprises at least one sensor which is shiftable sidewise in axial direction of the measuring roller.

In accordance with a concomitant feature of the invention, the opto-electronic measuring device comprises a plurality of sensors corresponding in number to the number of zone to be measured, the sensors being disposed in lateral mutual alignment in the axial direction of the measuring roller.

Other features which are considered as characteristic for the invention are set forth in the appended claims.

Although the invention is illustrated and described herein as embodied in a device for controlling, by a measuring technique, dampening medium guidance zonewise in an inking unit for an offset printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
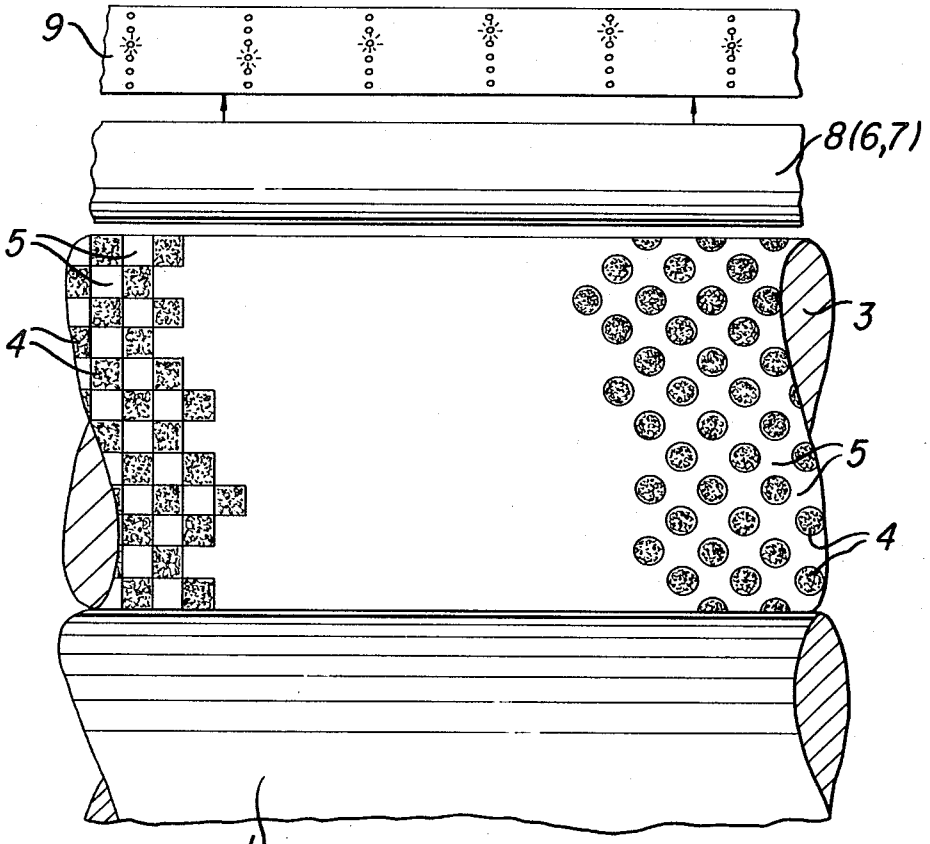
FIG. 1 is a fragmentary diagrammatic plan view of a measuring device constructed in accordance with the invention.

Referring now to the drawing and first, particularly, to FIG. 1 thereof, there is shown a measuring roller 3 placed in contact with an ink applicator roller 1 for a non-illustrated plate cylinder. In the interest of space economy, the contact of the measuring roller 3 is preferably shown as being with a last ink applicator roller 1. The surface of the measuring roller is formed of material having hydrophilic properties, preferably aluminum or chromium. In a similar manner as for the manufacture of a printing plate, an oleophilic screen 4, preferably of copper or a light-sensitive layer, is produced on the surface of the measuring roller 3. As shown in FIG. 1, the geometry of the oleophilic screen regions 4 may be circular punctiform or square punctiform and may have various degrees of surface or area coverages, the most desirable degree of area coverage, respectively, being determined empirically. The remaining surface regions 5 of the measuring roller 3 retain the hydrophilic character.

Figure 2:
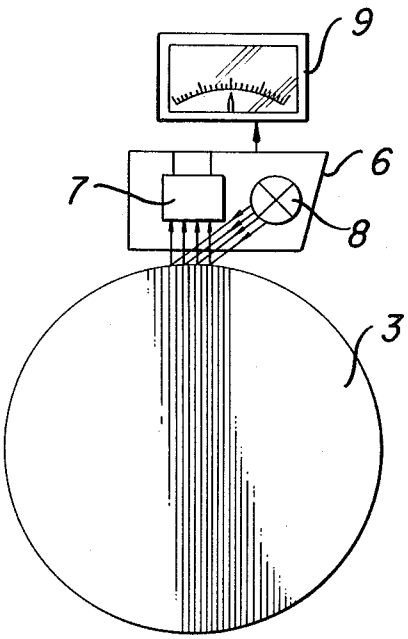
FIG. 2 is a side elevational view of FIG. 1.

As more clearly shown in FIG. 2, opposite the measuring roller 3, preferably thereabove, is an opto-electronic measuring device 6 of a conventional type of construction which is furnished with at least one sensor 7 shiftable sidewise in longitudinal direction of the measuring roller 3 and having a source 8 of radiation associated therewith. In this case, the measuring device 6 is coupled with an indicator or display 9 selectively switchable to different zones. The measuring device is preferably equipped with a plurality of sensors 7, however, each zone which is to be measured having its own individual sensor 7 assigned to it. In this embodiment of the invention, the indicator device 9 extends over the entire width of the printing machine and permits a simultaneous coherent or continuous representation of all of the measured values of the area coverage. The type of construction and function of such optoelectronic measuring devices 6 are known from the state of the art, for example from German Published Prosecuted Application (DE-AS) No. 27 36 663 and, therefore, are believed not to require more detailed illustration or further description.

In one embodiment of the invention, the oleophilic screen 4, as in the basic concept, has a uniform area coverage in an arbitrarily selectible amount of area coverage in the axial direction, yet is provided in circumferential direction of the measuring roller 3 with a non-uniform area coverage of different degrees of area coverage. The non-uniform area coverage can be gradated in steps, for example, with degrees of area coverage being 20, 30, 40, 50% and so forth, or can be formed as a non-gradated or stepless screen key 10 (FIG. 3) with a surface coverage decreasing from 100% to 0% or increasing from 0% to 100%.

The mode of operation with the measuring device according to the invention and the functional mode thereof are explained hereinafter in greater detail.

The oleophilic screen is seen in FIG. 1 as the part 4 of the surface of the measuring drum 3 that is black, and which, in operation, is covered with printer's ink. If the balance of dampening fluid to ink is skewed in direction of too much dampening fluid, part of the black areas will be blank, and conversely, if there is too much ink in relation to dampening fluid, part of the white areas will be covered with ink.

During the printing operation, printing ink is transferred from the ink application roller 1 to the measuring roller 3. In this regard, the oleophilic screen 4, namely the copper surface, accepts printing ink and is thus covered with ink, whereas the remaining hydrophilic surface regions 5, namely the aluminum or chromium surfaces, rejects i.e. does not accept the ink. The surface or area coverage of the oleophilic screen, due to the quantity of ink applied thereto, depends greatly upon the dampening-medium control or guidance. If the dampening medium control is set so that a feed which is too high is provided, the oleophilic screen 4 also thereby accepts less ink. The reverse situation exists for a dampening-medium feed which is too low.

As the drum rotates, exposed to ink and dampening fluid and is scanned by light from the light source 8 in FIG. 2, the reflected light impinges on a light sensor 7, and is read by an indicator device 9.

In one embodiment according to the most basic concept of the invention, as described above, the indicator device extends over (across) the entire width of the surface of the drum and the relative area coverage is uniform for the entire surface of the drum, and as a result, the readings on the indicator 9 represent a simultaneous, coherent or continuous representation of all of the measured values of the area coverage. The optical measuring device 6, per se, is conventional and is known, e.g. from German Published Prosecuted Application (DE-AS) No. 27 36 663, and is therefore believed to not require further detailed description, especially since photo-electric sensing and scanning devices have been known and used for such purposes for a long time.

With the measuring device 6, the area coverage and the variation thereof, respectively, are continuously measured on the oleophilic screen 4, preferably simultaneously in all of the zones. The measured values are converted into indicating signals in conventional method steps which are therefore not further described, are amplified and then represented in the indicating device 9 in analog or digital form. It is also possible, instead, to employ the measured values directly as adjustment commands or instructions for directly controlling or triggering zonal setting or positioning elements of a dampening unit. The variation of area coverage on the measuring roller 3 consequently represents a reliable measure of the printing quality.

Figure 3:
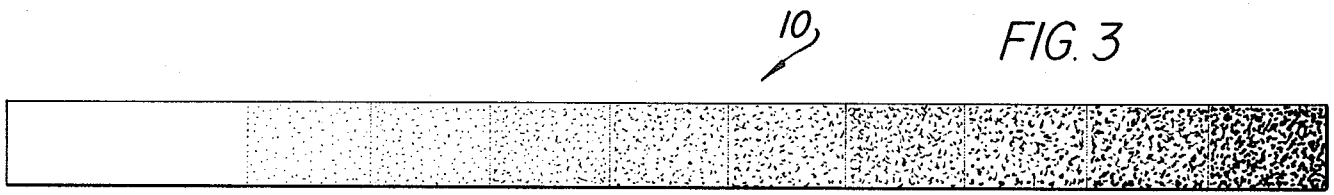
FIG. 3 is a view of a section of a zonal area of a measuring roller of the invention, developed in circumferential direction.

The hereinafore mentioned, uniformly graduated degree of area coverage of the oleophilic screen 4 in the circumferential direction of the measuring roller 3 of the embodiment according to FIG. 3 provides, in accordance with the selected graduation, a determination of the dampening variation in finely-divided graduated steps by measuring techniques. It has been found to be especially advantageous, in order to attain improved differentiation of the area coverage, to provide the measuring roller 3 with a stepless or continuously variable screen key 10. This type of screening is especially sensitive and responds very rapidly to minute variations in the area coverage variations.

Figure 4:
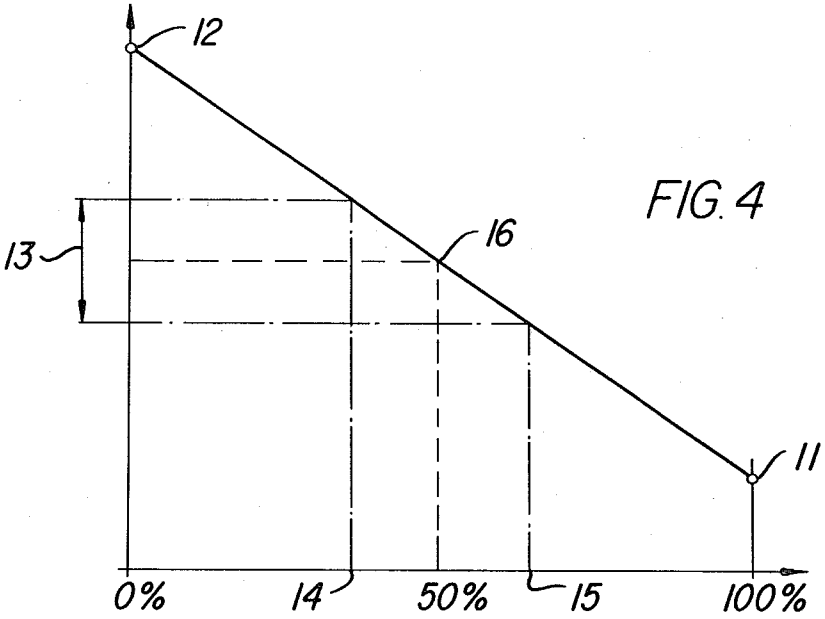
FIG. 4 is a plot diagram representing a theoretical characteristic curve of a sensor of the invention.

In this embodiment of the invention, the relative area coverage of the oleophilic screen 4 varies around the circumference from a ratio ranging from 0% to 100%, with the average area coverage for one revolution still being 50%. This makes the measuring device much more sensitive, because the ratio between the printed black and white areas does no always depend linearly upon the relative area coverage. As the coverage increases, as seen at the right hand end of the variable screen 10 seen in FIG. 3, the ink tends to clot and lump with insufficient dampening fluid. As a result, the average reading taken over one revolution of the measuring roller 3 from the scanning of the screen is not a linear function of the relative area coverage, but follows some other steeper curve. That is the reason for the increased sensitivity of the measuring drum having varied area coverage In the plot diagram of FIG. 4, the sensor signal at the ordinate is represented as a function of the area coverage of the measuring roller 3 shown at the abscissa. At the beginning of the progress, if the dampening unit has not yet been set or engaged and, therefore, no water has yet been emulsified with the ink, the measuring roller 3 accepts printing ink exclusively from the ink applicator roller 1 and is quite completely covered with the ink, so that the sensor or sensors 7 determine or ascertain 100% area coverage. The appertaining sensor signal of full-tone reflection is identified by reference character 11.

After the printing process has been initiated, and if the dampening unit has started to operate, and ink-/dampening-medium emulsion is formed in the inking unit, the measuring roller 3 will be accepting both ink as well as dampening medium. The area coverage and, to the same extent, the sensor signal are consequently changing. As can be clearly concluded from FIG. 4, the range of tolerance 13 of the dampening-medium control is determined by the upper and lower limits 14 and 15 thereof. The mean value of the dampening-medium control, if the ink found on the measuring roller 3 and the dampening medium are in proper balance, is shown in broken lines and identified by reference character 16. The extreme case opposing the full-tone reflection occurs when, for example, the measuring roller 3 runs blank i.e. without ink (point 12). In this case, the measuring radiation emitted from the radiation source 8 is totally reflected on the hydrophilic surface regions 5. The level of intensity of the sensor signal 12 of this total reflection corresponds to an extent of area coverage of the measuring roller 3 equal to 0%.

In operation, as the measuring roller is turning, while its actual ink surface coverage is being scanned, the indicating device 9 continuously receives an indication of the strength of the reflected light via the measuring device 6. The amount of reflected light is a direct measure of the actual ink coverage of the measuring drum 3 and the variation thereof, is continuously measured on the oleophilic screen 4. It follows that the variations read on the indicating device, and the variations can be either automatically or manually averaged in order to produce an indication which can be read by a machine operator and used to adjust and set the balance between dampening fluid and ink. It also follows that the readings can be made analog, as when read on a conventional analog meter having a scale and a pointer, or digital, having a numerical digital display.

Figure 6:
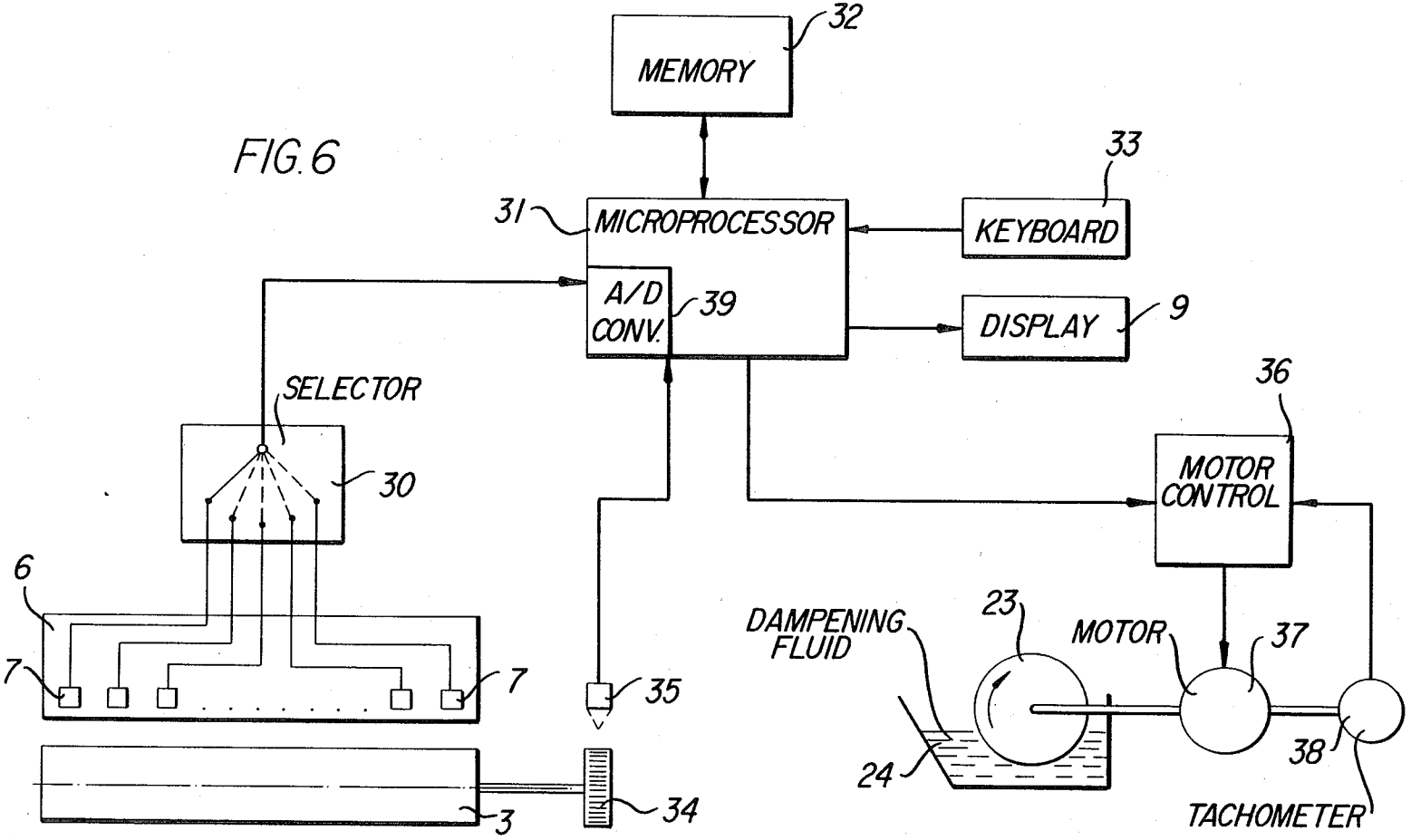
FIG. 6 is a block diagram of the device, according to the invention, showing the various function blocks.

It also follows that the measured values can be converted into indicating signals in conventional method steps, namely by radiating light beams from a radiation source 8 onto the surface of the measuring drum 3, and measuring the reflected radiation on a sensor 7, and connecting the sensor 7 to an indicating device 9, which is clearly shown e.g. in FIG. 2. The measured signals may be converted into control instruction and used to control the supply of dampening fluid, as shown in FIG. 6. Such measuring technology is old. The invention is not directed to the process of measuring the degree of reflected light, but to using conventional light scanning technology in connection with a measuring drum 3 having a surface raster of interlaced hydrophilic and oleophilic points for measuring the ink/dampening fluid balance.

Figure 5:
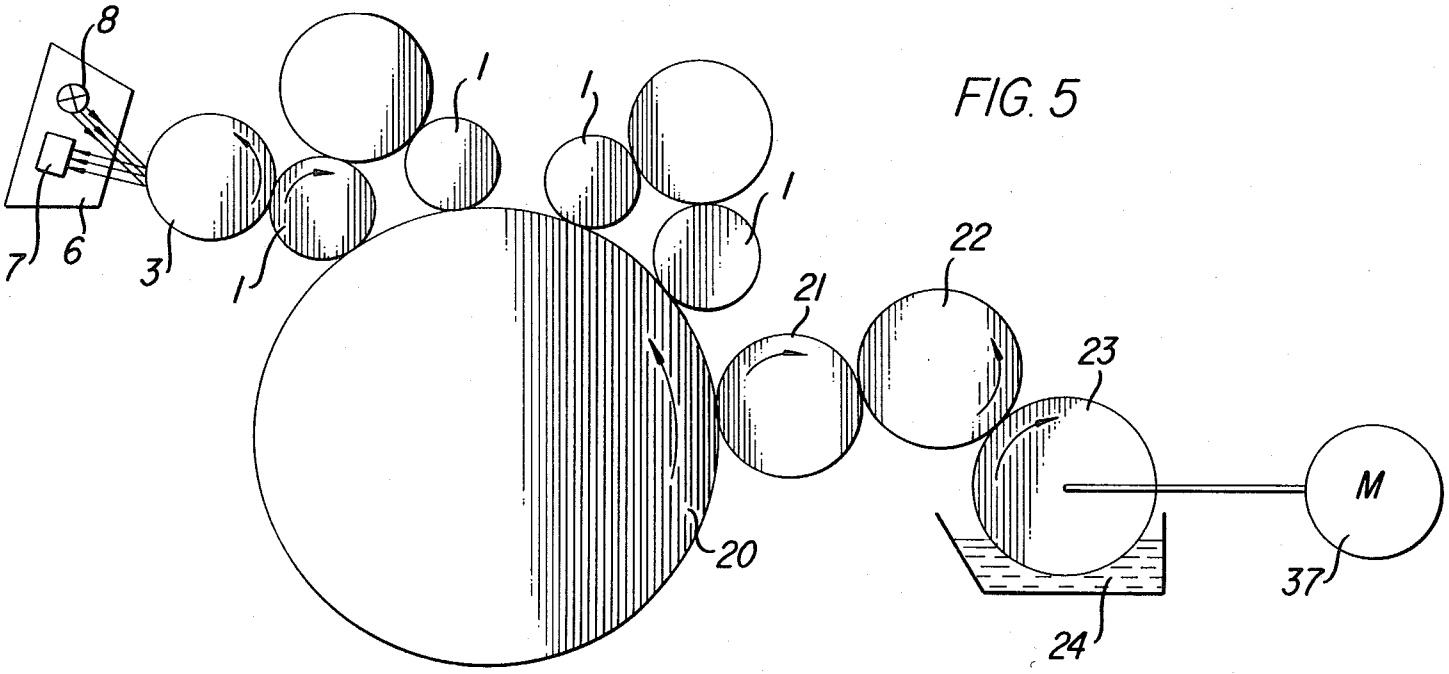
FIG. 5 is a diagrammatic view of a printing unit with associated rollers and showing the measuring roller with an optical scanning device.

In accordance with FIGS. 5 and 6, the measuring roller 3 can be brought into engagement with the last ink transfer roller 1. This last ink transfer roller serves essentially to transfer ink from the plate cylinder 20 to the measuring roller 3. the measuring roller 3 has, as described above, a surface screen consisting of intermingled or interlaced copper regions 4 and aluminum regions 5. The ink area coverage of the transfer roller 1 corresponds with the ink area coverage of the plate cylinder 20. As a result the surface of the measuring roller 3 emulates that of the plate roller 20. Therefore, if the ink layer at the surface of the plate cylinder 20, which consists of a mixture of ink and dampening fluid, has the correct balance, then the surface of the measuring roller 3 will also have the correct balance of ink, and the aluminum-chrome surface regions 5 will have no ink adhering thereto. But if the ink/dampening fluid emulsion on the plate cylinder should be lacking dampening fluid, e.g. as a result of evaporation, then, the copper plated areas 4 will appear to increase in size as the ink will overflow to the white areas 5, and the surface coverage of the measuring roller will increase. This condition can be measured by the light-scanning method described in the specification, and used to increase the feed of dampening fluid to the printing machine.

Conversely, if the dampening fluid content is too high, e.g. as at the start-up of the machine, then the ink coverage is reduced to the copper-plated points of the surface of the measuring roller 3. The light scan therefore shows increased light reflection. In the extreme case, if too much dampening fluid is provided, the surface of the measuring cylinder 3 may run blank, or conversely, if no dampening fluid at all is provided, ink may be smeared completely over the entire surface of the measuring cylinder.

The main fact that is important for the invention, is that the measuring cylinder 3 operates exactly as the plate cylinder, and is, as explained above, very sensitive to the proper ink/dampening fluid balance.

FIG. 6 shows details of the control apparatus and steps that may be used to be interposed between the light sensors 7 and the dampening fluid transfer roller 23 in order to control the supply of dampening fluid. The sensors 7, scanning the measuring drum 3 are accessed by a selector switch 30, connected to a microprocessor 31 via an analog-to-digital converter 39. The microprocessor 31, is as usual, engageable by a keyboard 33 engaging a display 9 for human interaction, and has a memory 32 for storing a control program controlling the microprocessor. The microprocessor also has an input from a timing wheel 34 scanned by a sensor 35 for providing a control clock.

The microprocessor 36 in turn drives the motor 37 via a motor control 36. The motor 37 is connected to a tachometer 38 which feeds the motor speed back to the motor control 36; and the motor 37 drives the dampening fluid roller 23 at a speed that transfers just enough dampening fluid to the intermediate rollers 21 and 22 to provide the proper ink/dampening fluid balance.

We claim:

1. Device for providing a zonewise dampening medium guidance signal in an inking unit of an offset printing machine, comprising a measuring roller engaging an ink applicator roller of the inking unit and having partly oleophilic and partly hydrophilic surface regions, and an opto-electronic measuring device disposed adjacent to said measuring roller and operating thereon over the entire width thereof at a spaced distance therefrom for generating said guidance signal, and wherein at least the oleophilic surface regions of said measuring roller is formed as a screen on the hydrophilic regions.

2. Device according to claim 1 wherein said oleophilic screen has a uniformly selected degree of surface area coverage measured in both axial and circumferential directions of said measuring roller.

3. Device according to claim 1 wherein said oleophilic screen, in the axial direction of said measuring roller has a uniform selected degree of surface area coverage, measured in axial direction, and has, in the circumferential direction of said measuring roller, a non-uniform stepped surface area coverage, having at least two different extreme degrees of area coverage.

4. Device according to claim 1 wherein the degree of surface area coverage of said oleophilic screen varies steplessly in circumferential direction of said measuring roller between areas having 100% and 0% area coverage.

5. Device according to claim 1 wherein the surface regions of said oleophilic screen are formed of copper, and the remaining hydrophilic surface regions are formed of a metal selected from the group consisting of aluminum and chromium.

6. Device according to claim 1 wherein said opto-electronic measuring device comprises at least one sensor which is shiftable sidewise in axial direction of said measuring roller.

7. Device according to claim 1 wherein said opto-electronic measuring device comprises a plurality of sensors corresponding in number to the number of zones to be measured, said sensors being disposed in lateral alignment in the axial direction of said measuring roller.

8. Apparatus for zonewise measurement of the dampening fluid supply in an offset printing machine, having a measuring roller in engagement with an ink-transfer roller, the measuring roller comprising: interlaced part hydrophilic and part oleophilic surface regions and at least one measuring sensor for scanningly measuring the dampening fluid/ink balance along the entire axial length of the measuring roller, and wherein the oleophilic surface regions of the measuring roller occupy, measured in circumferential direction, a continuously diminishing percentage of the total surface, said percentage diminishing from 100% to 0%.

9. Apparatus according to claim 8 comprising dampening fluid control means for controlling the supply of dampening fluid; linkage means interposed between said measuring sensor and said dampening fluid control means for controlling the supply of dampening fluid in response to said measured dampening fluid/ink balance.

10. Apparatus according to claim 9, wherein said dampening fluid control means include: an analog/digital converter connected to the output of said sensor, a microprocessor responsively connected to said analog/digital converter, a motor for feeding dampening fluid, a motor control engaging said motor for controlling the output of dampening fluid from said motor, said motor control responsively connected to an output from said micro-processor.

11. Apparatus according to claim 10 further comprising a memory connected to said microprocesor for controlling the supply of dampening fluid.

12. Apparatus according to claim 11, wherein said linkage means comprising a plurality of sensors; a selector for selectively selecting at least one of said sensors to be connected to said analog/digital converter.

* * * * *